US009601011B1

(12) United States Patent
Burke et al.

(10) Patent No.: US 9,601,011 B1
(45) Date of Patent: Mar. 21, 2017

(54) MONITORING AND REPORTING SLOW DRIVERS IN FAST HIGHWAY LANES

(71) Applicants: Bertram V Burke, Lecanto, FL (US); Michaela C. Burke, Lecanto, FL (US)

(72) Inventors: Bertram V Burke, Lecanto, FL (US); Michaela C. Burke, Lecanto, FL (US)

( * ) Notice: Subject to any disclaimer, the term of this patent is extended or adjusted under 35 U.S.C. 154(b) by 0 days.

(21) Appl. No.: 15/248,574

(22) Filed: Aug. 26, 2016

Related U.S. Application Data

(60) Provisional application No. 62/210,357, filed on Aug. 26, 2015.

(51) Int. Cl.
*G08B 21/00* (2006.01)
*G08G 1/052* (2006.01)

(52) U.S. Cl.
CPC ..... *G08G 1/052* (2013.01)

(58) Field of Classification Search
CPC ..... G08G 1/052
USPC ..... 340/435, 438, 463, 936
See application file for complete search history.

(56) References Cited

U.S. PATENT DOCUMENTS

2004/0193347 A1* 9/2004 Harumoto ..... B60R 21/0132 701/45
2011/0320492 A1 12/2011 Inghelbrecht
2012/0287278 A1 11/2012 Danis
2013/0201035 A1 8/2013 Leopold et al.

* cited by examiner

*Primary Examiner* — Jeffery Hofsass
(74) *Attorney, Agent, or Firm* — Mark Terry

(57) ABSTRACT

A system for logging and reporting on slow drivers in a fast lane is disclosed. The system includes a set of proximity sensors on a first vehicle, for detecting a passage of another vehicle on a right side of the first vehicle, a processor on the first vehicle, for logging a number of times that another vehicle passed the first vehicle, a transmitter on the first vehicle, for transmitting said number of times to a vehicle that is detected as passing the first vehicle on a right side of the first vehicle, a set of proximity sensors on a second vehicle, a receiver on the second vehicle, a processor on the second vehicle, for storing said number of times received via said at least one receiver, and a transmitter on the second vehicle, for transmitting said number of times to a third party.

20 Claims, 10 Drawing Sheets

MONITORING AND REPORTING SLOW DRIVERS IN FAST HIGHWAY LANES

CROSS-REFERENCE TO RELATED APPLICATIONS

This patent application claims priority to provisional patent application No. 62/210,357 filed Aug. 26, 2015, titled "Monitoring and Reporting Slow Drivers in Fast highway Lanes." The subject matter of patent application No. 62/210,357 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to vehicles, such as cars, trucks, vans, motor homes, etc. and, more specifically, to processes for improving vehicle driver behavior on highways.

BACKGROUND

A passing lane, fast lane or overtaking lane is the lane on a multi-lane highway or roadway closest to the left side of the road. In modern traffic planning, passing lanes on freeways are usually designed for through/express traffic, while the remaining lanes are for slower traffic. A passing lane is commonly referred to as a "fast lane" because it is often used for extended periods of time for through traffic or fast traffic. In theory, a passing lane should be used only for passing, thus allowing, even on a road with only two lanes in each direction, motorists to travel at their own pace. Common practice on United States highways is that the left lane is reserved for passing and faster moving traffic, and that traffic using the left lane must yield to traffic wishing to overtake. Evidence exists demonstrating the efficiency of this practice. The United States Uniform Vehicle Code states: Upon all roadways any vehicle proceeding at less than the normal speed of traffic at the time and place and under the conditions then existing shall be driven in the right-hand lane then available for traffic. It is also illegal in many states in the U.S. to fail to yield to faster moving traffic that is attempting to overtake in the fast lane.

A common problem arising from misuse of the left lane is speeding and tailgating. These actions create road rage and increase overall danger. A driver hoping to pass a slow motorist in the "fast lane" can be stuck in an awkward situation. One strategy, which is dangerous and illegal, is to drive very close to the "fast lane" driver's bumper (this is known as tailgating). The National Safety Council estimates 38,300 people were killed and 4.4 million injured on U.S. roads in 2015, which saw the largest one-year percentage increase in deaths in half a century, resulting in an average of 105 deaths and 12,055 injuries per day. Many accidents are caused by slow drivers in the left lane. These slow drivers annoy other impatient drivers who are driving faster, causing them to move in and out of traffic, which results in accidents.

It should also be noted that when a slow vehicle stays in the left or fast lane and blocks faster vehicles, the driving violation may be almost invisible to the casual observer. This is because traffic keeps flowing and the infraction effectively disappears to the casual observer. Thus, the problem caused by slow drivers in the fast lane can be difficult to identify and ascertain.

Various approaches exist for monitoring vehicles in lanes on highways and roads. Two well-known approaches employ a sensor to measure vehicle speeds in multiple lane highways from a fixed overhead structure. Another known approach also employs a sensor used from a fixed physical position to monitor vehicles in their respective lanes. But none of the above cited approaches detect and solve the problem of slow drivers blocking the path of faster drivers in the left lane of roads and highways.

Therefore, a need exists for improvements over the prior art, and more particularly for more efficient methods and systems for improving the driving behavior of drivers on the public highways, namely, slow drivers in the fast lane.

SUMMARY

A method and system for logging and reporting on slow drivers in a fast lane is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for logging and reporting on slow drivers in a fast lane, the system comprising: a set of proximity sensors on a first vehicle, wherein said set of proximity sensors are configured for detecting a passage of another vehicle on a right side of the first vehicle; at least one processor on the first vehicle, the at least one processor communicatively coupled with the set of sensors on the first vehicle, the at least one processor configured for logging a number of times that the another vehicle passed the first vehicle on a right side of the first vehicle; at least one transmitter on the first vehicle, the transmitter communicatively coupled with the at least one processor on the first vehicle, the transmitter configured for wirelessly transmitting said number of times to a vehicle that is detected as passing the first vehicle on a right side of the first vehicle, a set of proximity sensors on a second vehicle, wherein said set of proximity sensors on the second vehicle are configured for detecting a passage of another vehicle on a left side of the second vehicle; at least one receiver on the second vehicle, the at least one receiver communicatively coupled with the at least one processor on the second vehicle, the at least one receiver configured for wirelessly receiving communications from another vehicle; at least one processor on the second vehicle, the at least one processor on the second vehicle communicatively coupled with the set of sensors on the second vehicle and the at least one receiver on the second vehicle, the at least one processor configured for storing said number of times received via said at least one receiver; and at least one transmitter on the second vehicle, the transmitter communicatively coupled with the at least one processor on the second vehicle, the transmitter configured for wirelessly transmitting said number of times to a third party via a communications network.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
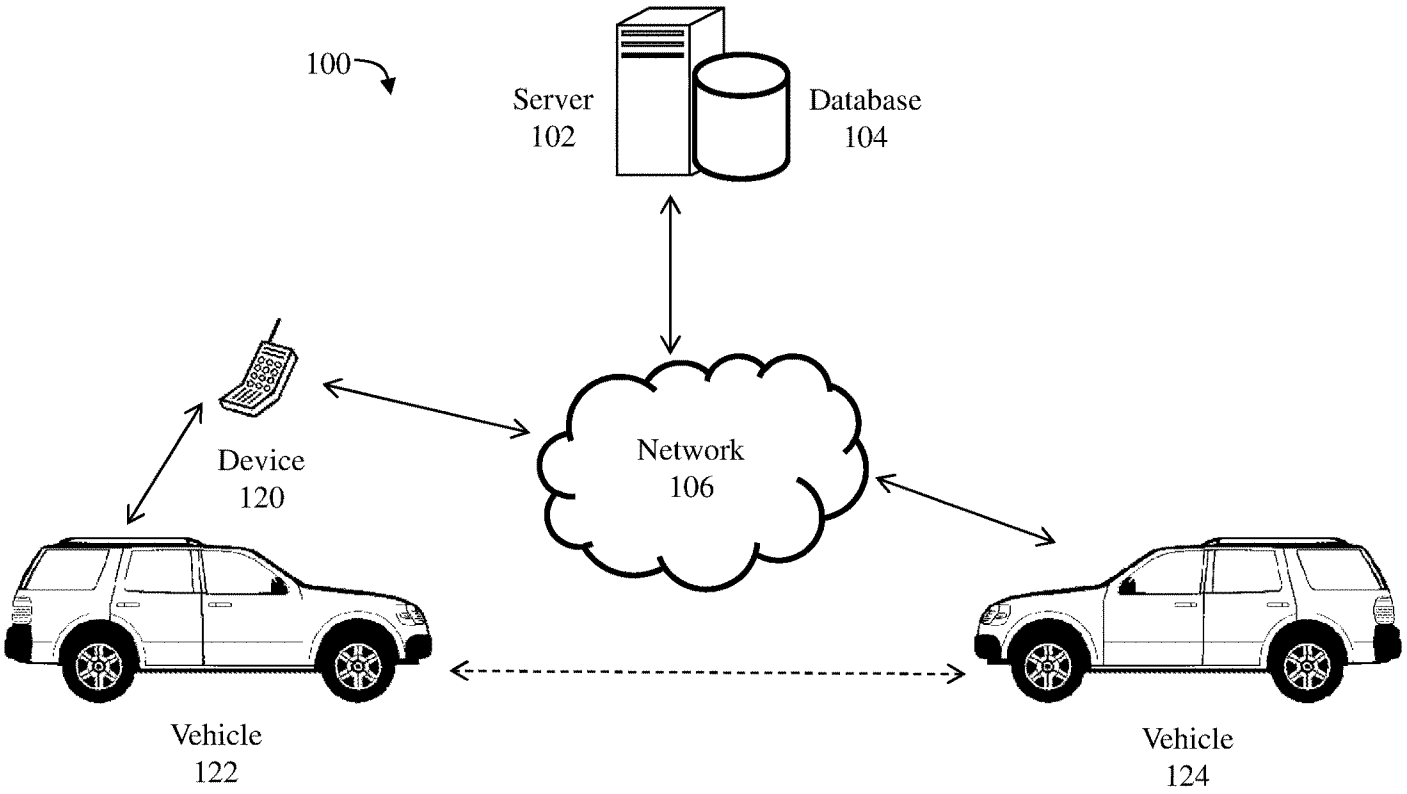
FIG. 1 is a diagram of an operating environment that supports a method and system for logging and reporting on slow drivers in a fast lane, according to an example embodiment.

The following detailed description refers to the accompanying drawings. Wherever possible, the same reference numbers are used in the drawings and the following description to refer to the same or similar elements. While embodiments herein may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing a more efficient, safe and precise way of monitoring drivers that are driving too slowly in the fast lane. The claimed subject matter utilizes active proximity sensors to report vehicle speeds and lane information (namely, slow drivers in the fast lane) to other drivers on a vehicle to vehicle basis. The claimed subject matter records and, through its effects, changes the behavior of slow drivers in the left lane and the manner in which the slow drivers operate and block faster vehicles in the fast lane of roads and highways. The claimed subject matter acts as an educational, and potentially an enforcement, tool for all drivers on roads and highways, especially slow drivers in the fast lane. The claimed subject matter reduces traffic congestion and lessens the need for faster drivers to impulsively switch from the fast left lane over to slower right lane and back again to the fast lane, which can cause accidents. Effectively, the claimed subject matter improves drivers' operational behavior on a daily basis, especially slow drivers in the fast lane.

FIG. 1A is a diagram of an operating environment 100 that supports a method and system for logging and reporting on slow drivers in a fast lane. The server 102 may be communicatively coupled with a communications network 106, according to an example embodiment. The environment 100 comprises vehicles 122, 124 with computing devices that may communicate with server 102 via a communications network 106. Vehicle 122 is associated with a mobile computing device 120, which may comprise a cellular/mobile telephone, smart phone, tablet computer, laptop computer, handheld computer, wearable computer, network connection device, or the like. Vehicles 122, 124 may also comprise other computing devices such as desktop computers, workstations, servers, and game consoles, for example. The mobile computing device 120, and vehicles 122, 124, may be connected either wirelessly or in a wired or fiber optic form to the communications network 106. Communications network 106 may be a packet switched network, such as the Internet, or any local area network, wide area network, enterprise private network, cellular network, phone network, mobile communications network, or any combination of the above. Server 102, mobile computing device 120, and vehicles 122, 124 may each comprise a computing device 600, described below in greater detail with respect to FIG. 6.

In another embodiment, mobile computing device 120, and vehicles 122, 124 may also calculate current geographical position (otherwise referred to as geographical location data) using an on-board processor or a connected processor. In one embodiment, the devices may calculate current position using a satellite or ground based positioning system, such as a Global Positioning System (GPS) system, which is a navigation device that receives satellite or land based signals for the purpose of determining the device's current geographical position on Earth. A satellite navigation system with global coverage may be termed a global navigation satellite system (GNSS). A GPS receiver, and its accompanying processor, may calculate latitude, longitude and altitude information. In this embodiment, a radio frequency signal is received from a satellite or ground based transmitter comprising a time the signal was transmitted and a position of the transmitter. Subsequently, the device calculates current geographical location data of the device based on the signal. In another embodiment, the device calculates current geographical location using alternative services, such as control plan locating, GSM localization, dead reckoning, or any combination of the aforementioned position services. The term spatial technologies or spatial processes refers generally to any processes and systems for determining one's position using radio signals received from various sources, including satellite sources, land-based sources and the like.

Server 102 includes a software engine that delivers applications, data, program code and other information to networked devices, such as mobile computing device 120, and vehicles 122, 124. The software engine of server 102 may perform other processes such as transferring multimedia data in a stream of packets that are interpreted and rendered by a software application as the packets arrive. FIG. 1 further shows that server 102 includes a database or repository 104, which may be a relational database comprising a Structured Query Language (SQL) database stored in a SQL server. Mobile computing device 120, and vehicles 122, 124 may also include their own database, either locally or via the cloud. The database 104 may serve contact data, passing data, message data, as well as related information, which may be used by server 102, mobile computing device 120, and vehicles 122, 124.

Server 102, mobile computing device 120, and vehicles 122, 124 may each include program logic comprising computer source code, scripting language code or interpreted language code that perform various functions of the disclosed embodiments. In one embodiment, the aforementioned program logic may comprise program module 607 in FIG. 6. It should be noted that although FIG. 1 shows only one mobile computing device 120, two vehicles 122, 124, and one server 102, the system of the disclosed embodiments supports any number of servers, vehicles and mobile computing devices connected via network 106. Also note that although server 102 is shown as a single and independent entity, in one embodiment, server 102 and its functionality can be realized in a centralized fashion in one computer system or in a distributed fashion wherein different elements are spread across several interconnected computer systems.

Environment 100 may be used when mobile computing device 120, and vehicles 122, 124 engage in traffic logging and reporting activities that comprise reading, generating, and storing passing data, contact data, message data and related information. Various types of data may be stored in the database 104 of server 102 (as well as data storage on mobile computing device 120, and vehicles 122, 124) with relation to traffic logging and reporting. For example, the database 104 (or mobile computing device 120, and vehicles 122, 124) may store one or more user records for each vehicle or user. A user record may include a user name, address, age, location, credit card information, email address, phone number, vehicle type, vehicle make, vehicle model, vehicle VIN number, vehicle color, license plate data, vehicle efficiency information, driver's license data, vehicle registration data, etc.

In another example, the database 104 (as well as data storage on mobile computing device 120, and vehicles 122, 124) may store passing data and message data. Passing data may include data related to the passing of one vehicle by another. Passing data may include contact or identifying data for one or more vehicles (such as any of the user record data above), the date and time of each passing incident, weather conditions for each passing incident, the speed of each vehicle in each passing incident, the number of times of passing incidents, the geographical locations of each vehicle in each passing incident, etc. Passing data may also include images, photographs and videos of a vehicle that has been passed or of the vehicle being passed itself. Message data may include text message data, audio message data, video message data, unique identifiers, code data, etc. In another embodiment, any of the data mentioned above may be stored in a separate file or record that is associated with a corresponding user record.

Figure 4:
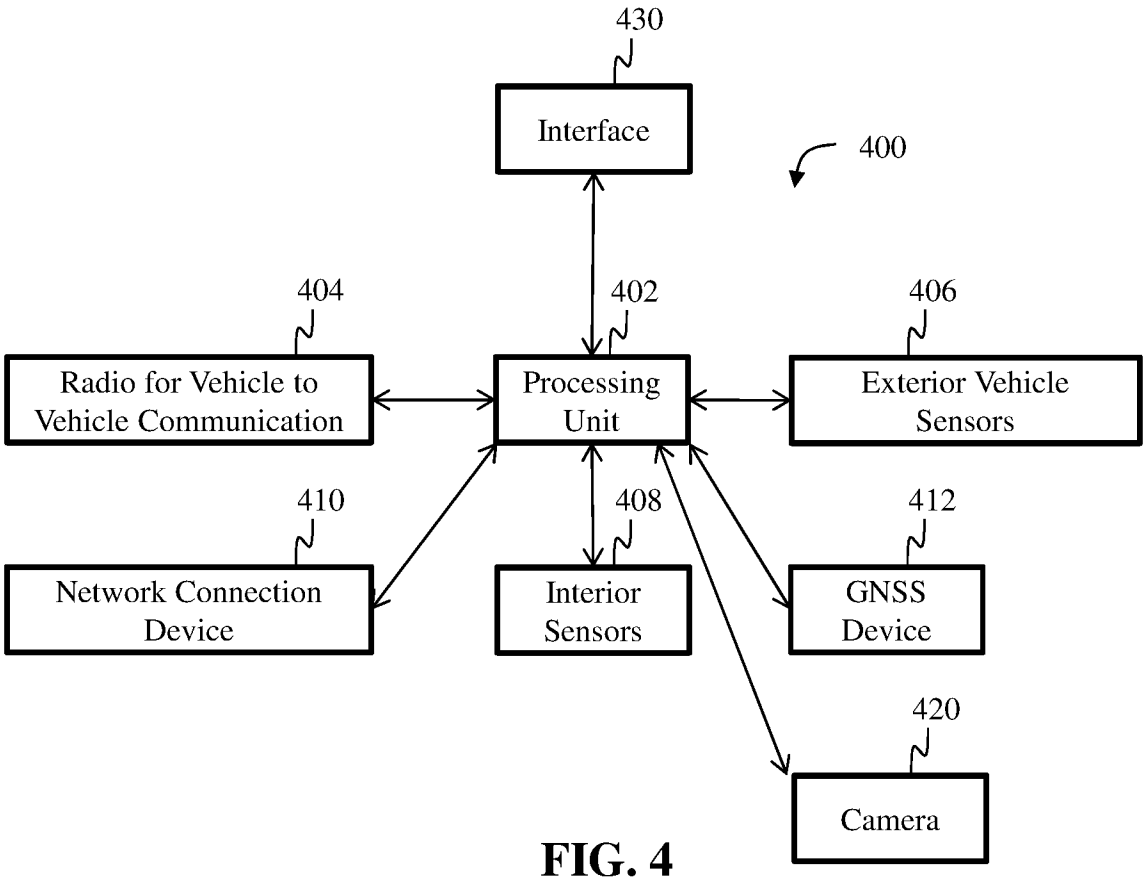
FIG. 4 is a block diagram showing the main components of a system on a vehicle, according to an example embodiment.

FIG. 4 is a block diagram showing the main components of a system 400 on a vehicle, such as 122, 124, according to an example embodiment. The system 400 includes a processor or processing unit 402 (described in more detail below with reference to FIG. 6) communicatively coupled with interior sensors 408, as well as exterior vehicle sensors 406 configured for detecting a passage of another vehicle on its side. Processor 402 is configured for detecting a passage of another vehicle on its side and for logging or storing a number of times that another vehicle has passed itself.

Interior sensors 408 refer to sensors that measure data pertaining to the vehicle on which the system 400 is located, such as speed sensors, engine status sensors, etc. The system 400 also includes a radio 404 for vehicle-to-vehicle communications, which may include a radio transmitter and receiver, as well as geographical location sensors, such as a GPS or GNSS system 412. The system 400 also includes a network connection device 410, used for communicatively coupling the system 400 to the network 106, described in greater detail below with reference to FIG. 6. The system 400 may also include a camera 420, used for taking images, photographs, video, etc. The system 400 may also include human interface 430 that may include a screen, display, microphone, speakers, buttons, touchscreen, etc.

Figure 5A:
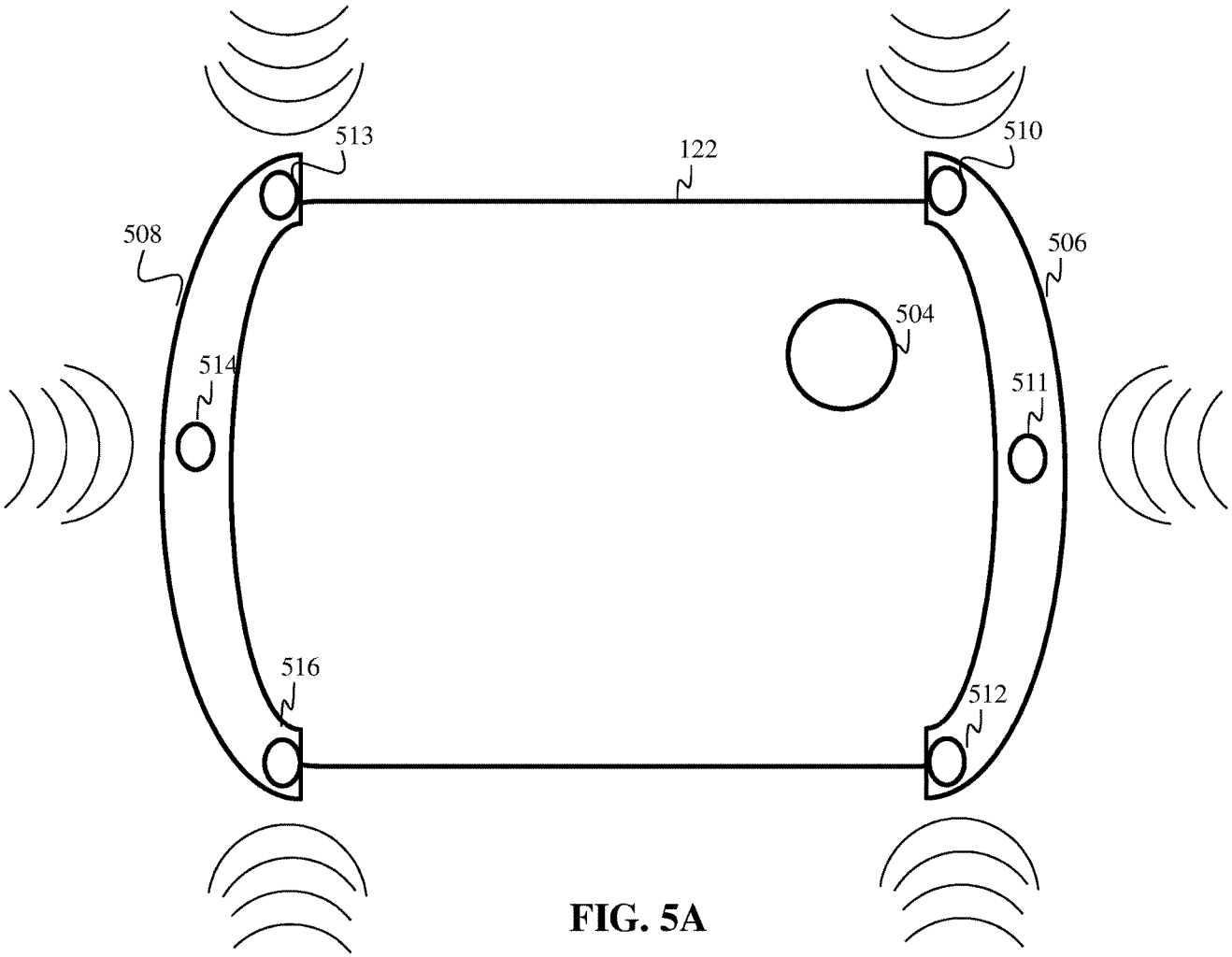
FIGS. 5A through 5E are illustrations showing subject vehicles and a highway passing scenario, according to an example embodiment.

Exterior vehicle sensors 406 refers to proximity or near-field object sensors that detect the passing of another vehicle in another lane. The exterior vehicle sensors 406 may be proximity sensors that are laser based, acoustic or ultrasonic based, RADAR based, or the like. The sensors 406 typically comprise a system that emits a signal (weather it is acoustic, laser, etc.) that receives a return signal, thereby collecting data about the surrounding environment. FIG. 5A shows how a vehicle 122 (with steering wheel 504) may include three exterior vehicle sensors 510, 511, 512 on the front bumper 506 of the vehicle, and three exterior vehicle sensors 513, 514, 515 on the rear bumper 508 of the vehicle. FIG. 5A shows that each proximity sensor 510 through 516 senses proximity to another vehicle or object in a different direction extending radially out from the vehicle 122. In one embodiment, the above exemplary sensors includes all of the functions of said conventional sensors, which are well known in the art. FIG. 5A shows the placement of six sensors 510 through 516 respectively positioned on the front and back bumpers in the position of left, middle and right positions. The sensors can be built into the bumpers at the time of manufacturing or attached to the vehicle's front and rear bumpers, mirrors, windshields, etc. If the sensors are built into the bumpers, the bumpers may have optically transmissive, radio frequency permeable or radio frequency transmissive windows or areas built into them. The sensors may be installed by the Original Equipment Manufacturer (OEM) or added at a later time as a retro-fit with the needed sensors and microprocessors.

In one embodiment, three of said set of six proximity sensors on the vehicle are located on a right side of the vehicle and three of said set of six proximity sensors are located on a left side of the vehicle. Alternatively, two of said set of six proximity sensors are located at or near a middle of the vehicle on the left side of the vehicle and two of said set of six proximity sensors are located at or near a middle of the vehicle on the right side of the vehicle.

In another embodiment, the placement of a sensor would be in any physical position that effectively captures the presence of another vehicle. Two of said set of six proximity sensors may be located on a right side of the vehicle, two of said set of six proximity sensors may be located on a left side of the vehicle, one sensor may be located on the front of the vehicle and one sensor may be located on the rear of the vehicle.

The microprocessor 402 and the associated software may also calculate vehicle speed by calculating the time a vehicle takes to pass between the two beams (emitted by one or more of the sensors 406. Specifically, the microprocessor 402 utilizes a microsecond time increment, and is reset to zero when the first beam detects the presence of a vehicle, and is read when the vehicle is detected by the second beam. To determine the vehicle speed, the software automatically calculates the distance between the two beams. The speed is then identified by calculating the distance between the beams and dividing it by the time the vehicle takes to travel that distance.

The sensors 406 can also be utilized to ascertain the existence of poor highway visibility conditions, which is useful in providing a warning to drivers to slow down because of dangerous visibility conditions. The amplitude of the return signal received by the vehicle sensor is proportional to the atmospheric transmittance (visibility). Analysis has shown that the sensor can detect vehicles until heavy fog or rainfall reduces the visibility range to, for example, 18 m. The return signal corresponds to the change in visibility from clear day to foggy conditions, wherein the received signal power may decrease by a large factor. Thus, a measurement of the return-signal amplitude can be used to ascertain the existence of poor highway visibility conditions. If the microprocessor 402 senses a return-signal level from the roadway below a certain preselected threshold, then the software can initiate an output through an interface to an appropriate visibility warning signal.

Figure 2:
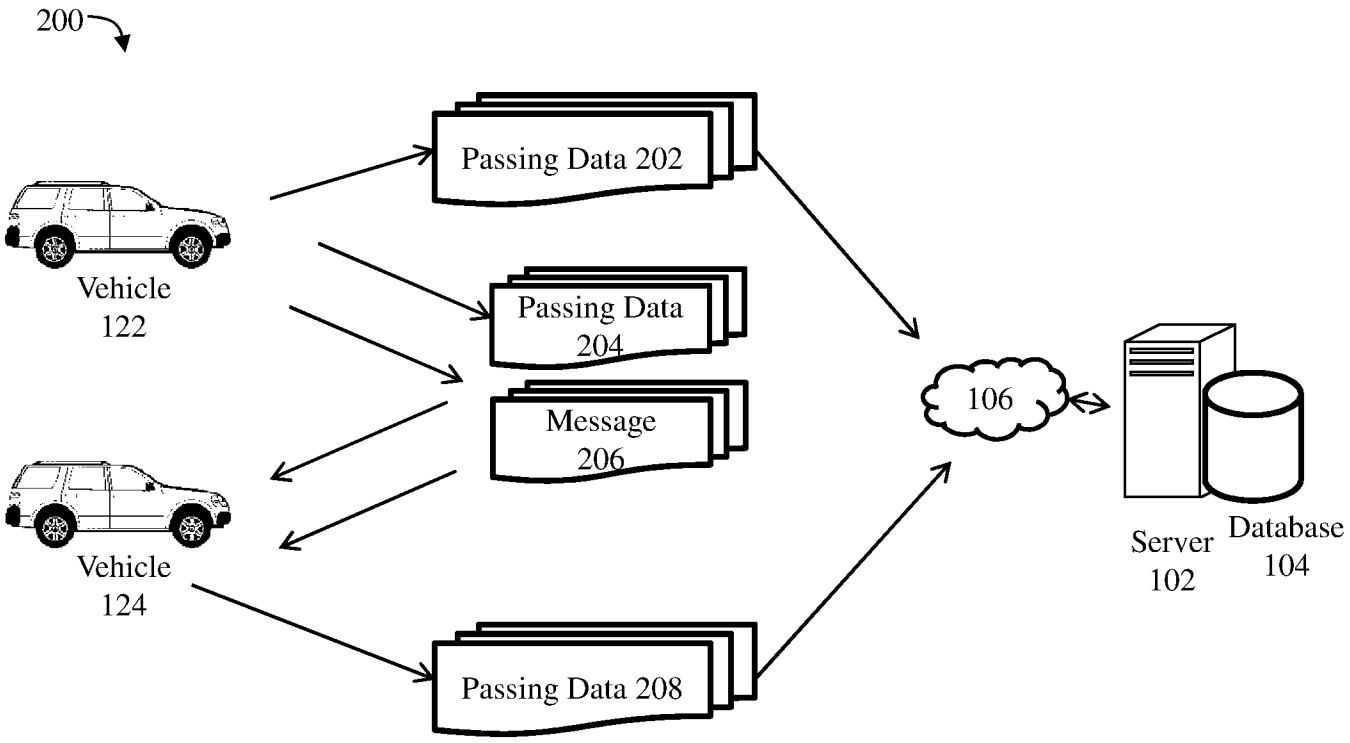
FIG. 2 is a diagram showing the data flow of the general process for logging and reporting on slow drivers in a fast lane, according to an example embodiment.
Figure 3:
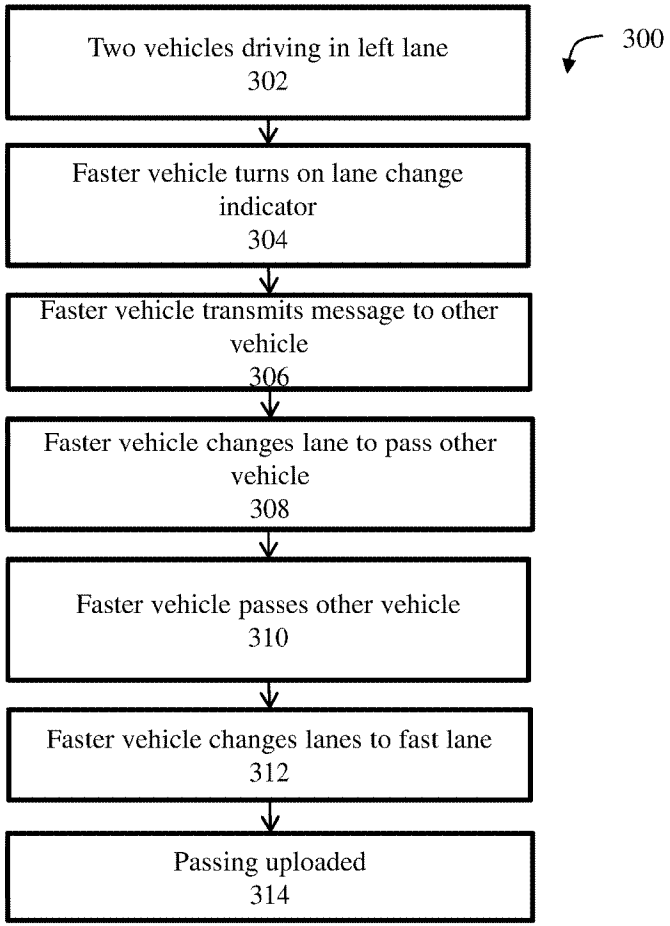
FIG. 3 is a flow chart showing the control flow of the process for logging and reporting on slow drivers in a fast lane, according to an example embodiment.

FIG. 3 is a flow chart showing the control flow of the process 300 for logging and reporting on slow drivers in a fast lane, according to an example embodiment. Process 300 describes the steps that occur when the systems 100 and 400 are used in a traffic logging and reporting scenario. The process 300 is described with reference to FIG. 2, which shows the general data flow 200 of the process 300, as well as FIGS. 5A through 5B.

Figure 5B:
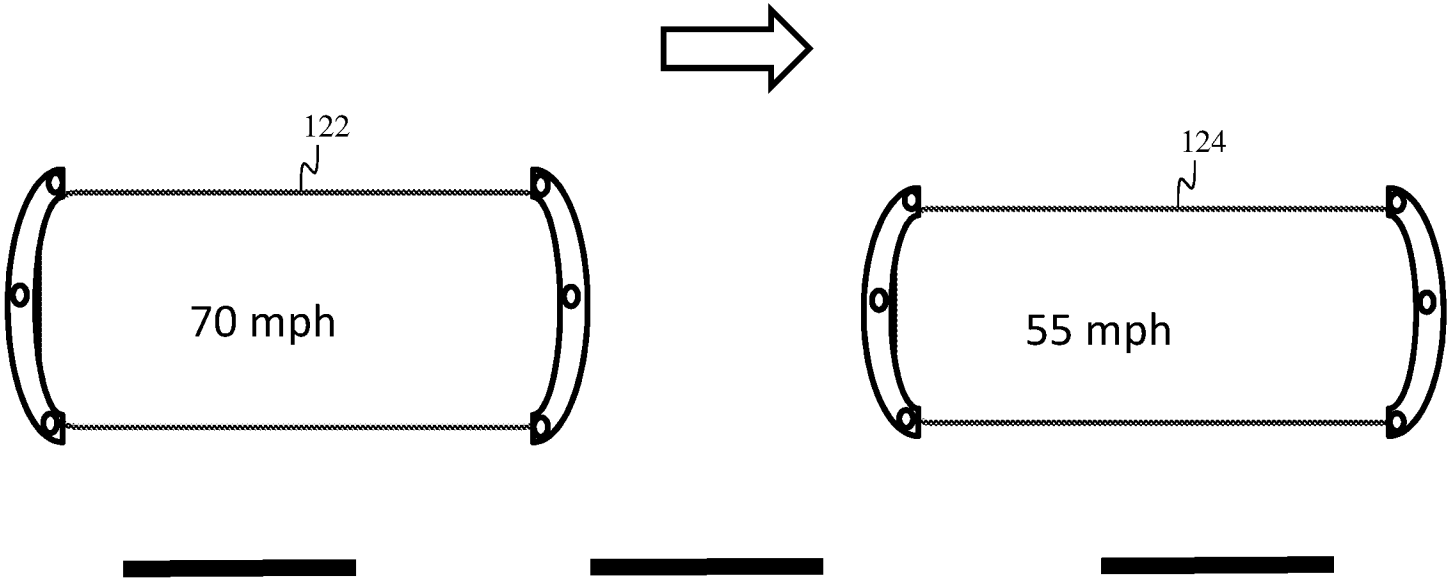

Process 300 starts with step 302 wherein, as shown in FIG. 5B, two vehicles 122, 124 are traveling in the left lane driving at two different speeds. Vehicle 124 is in the lead and is going 55 mph while vehicle 122 is coming from behind and is going 70 mph.

In one embodiment, the processor 402 of each vehicle is configured for detecting a speed of the vehicle and disabling the set of proximity sensors on the vehicle if said speed is below a predefined threshold, and then enabling the set of proximity sensors on the vehicle if said speed is above a predefined threshold.

In step 304, prior to vehicle 122 moving over to the right lane to pass vehicle 124, the driver in vehicle 122 turns on his right hand directional signal indicating that he intends to move over to the right hand lane and pass vehicle 124 on the right. Optionally, in step 304, a camera on vehicle 122 takes an image or photograph of the vehicle 124 including its license plate, and stores said image or photograph.

In optional step 306, system 400 in vehicle 122 transmits a message 206 to vehicle 124 indicating vehicle 124 is about to be passed. Said message 206 may be displayed in the interface 430 of system 400 on vehicle 124. Now the driver in vehicle 124 is aware that he will soon be passed by vehicle 122 in the right lane.

The system 400 of vehicle 122 may include a set of pre-recorded voice messages or other signals, wherein the transmitter of vehicle 122 is configured to transmit certain ones of the pre-recorded messages or other signals to vehicle 124, when the set of proximity sensors of vehicle 122 detects the passage of vehicle 124 on the left side of vehicle 122. The receiver of the vehicle 124 is configured for receiving certain ones of the pre-recorded messages or other signals from vehicle 122, and includes an audio speaker communicatively coupled with the at least one processor on vehicle 124, the audio speaker configured for playing said certain ones of the pre-recorded messages or other signals received.

The system 400 of vehicle 124 may include a set of pre-recorded voice messages or other signals, wherein the transmitter of vehicle 124 is configured to transmit certain ones of the pre-recorded messages or other signals to vehicle 122, when the set of proximity sensors of vehicle 124 detects the passage of vehicle 122 on the right side of vehicle 124. The receiver of the vehicle 122 is configured for receiving certain ones of the pre-recorded messages or other signals from vehicle 124, and includes an audio speaker communicatively coupled with the at least one processor on vehicle 122, the audio speaker configured for playing said certain ones of the pre-recorded messages or other signals received.

Figure 5C:
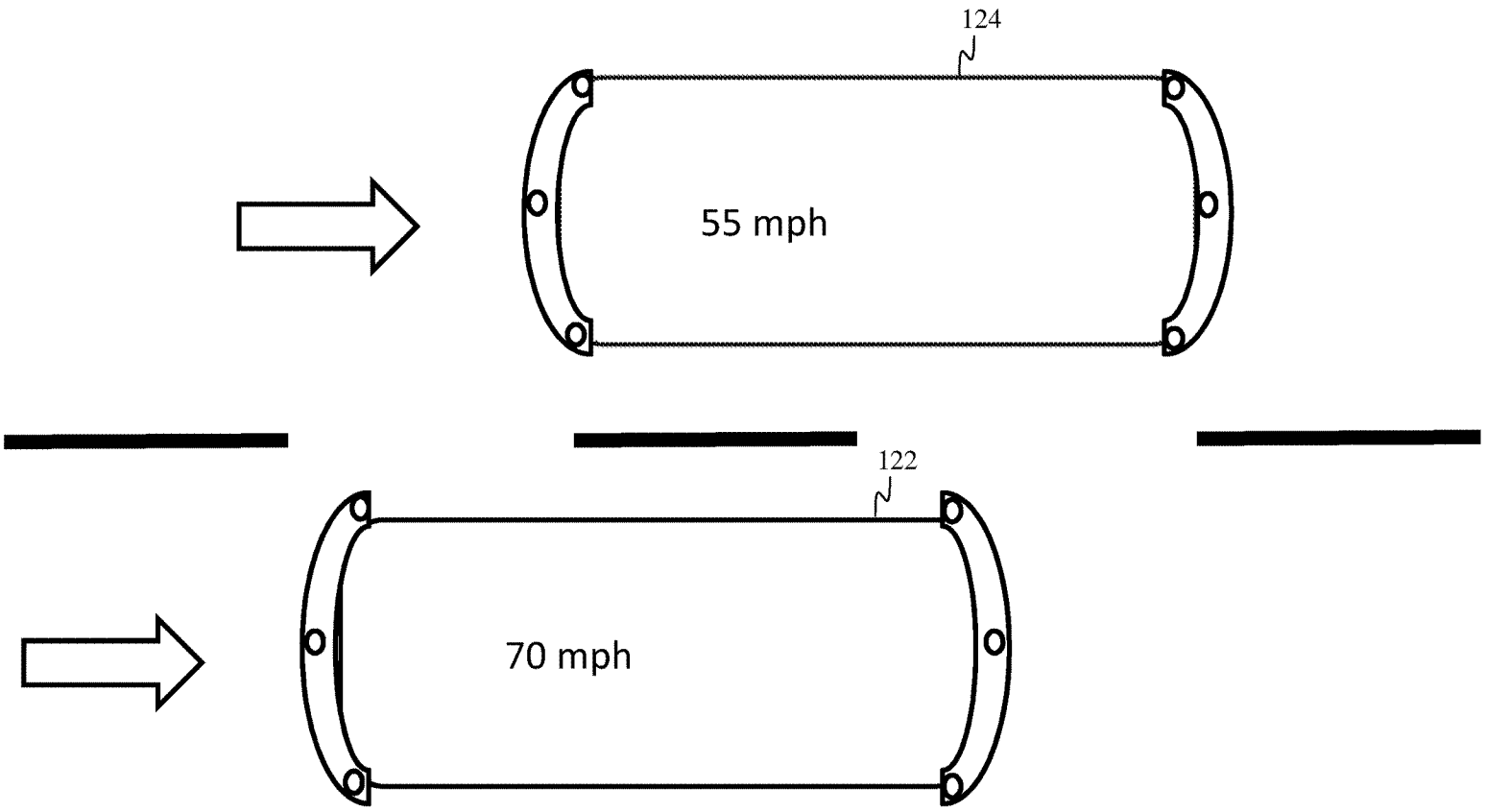

In step 308, as shown in FIG. 5C, vehicle 122 going 70 mph has now moved over to the right lane and is now passing vehicle 124 from the right lane. The sensors on both vehicles sense the passing that is occurring and thereby generate and store said passing data.

Figure 5D:
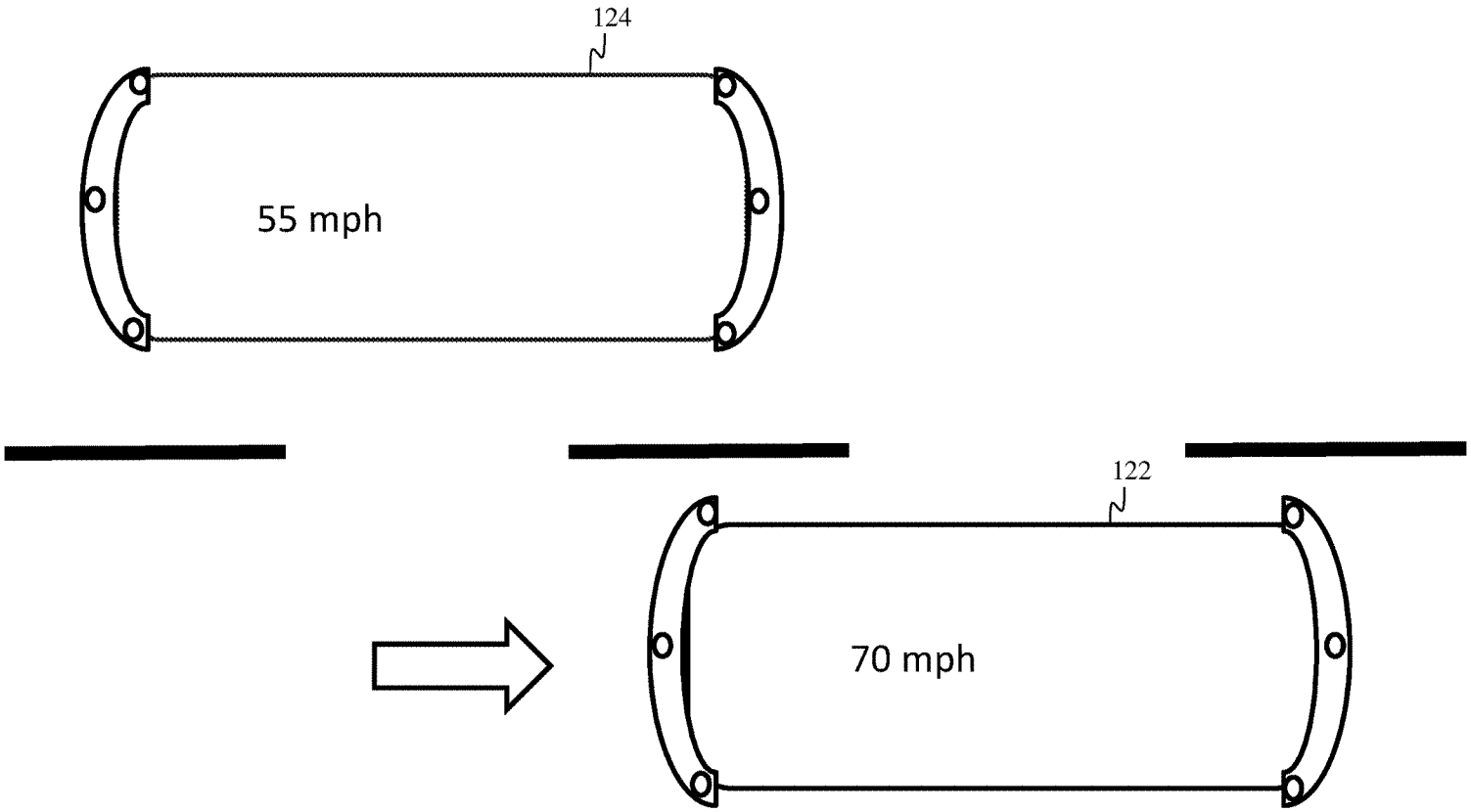

In step 310, as shown in FIG. 5D, vehicle 122 has passed vehicle 124, and the system 400 of vehicle 122 may finish generating passing data 204 and transmits said data to vehicle 124 indicating that it has been passed by a vehicle going 70 mph.

Figure 5E:
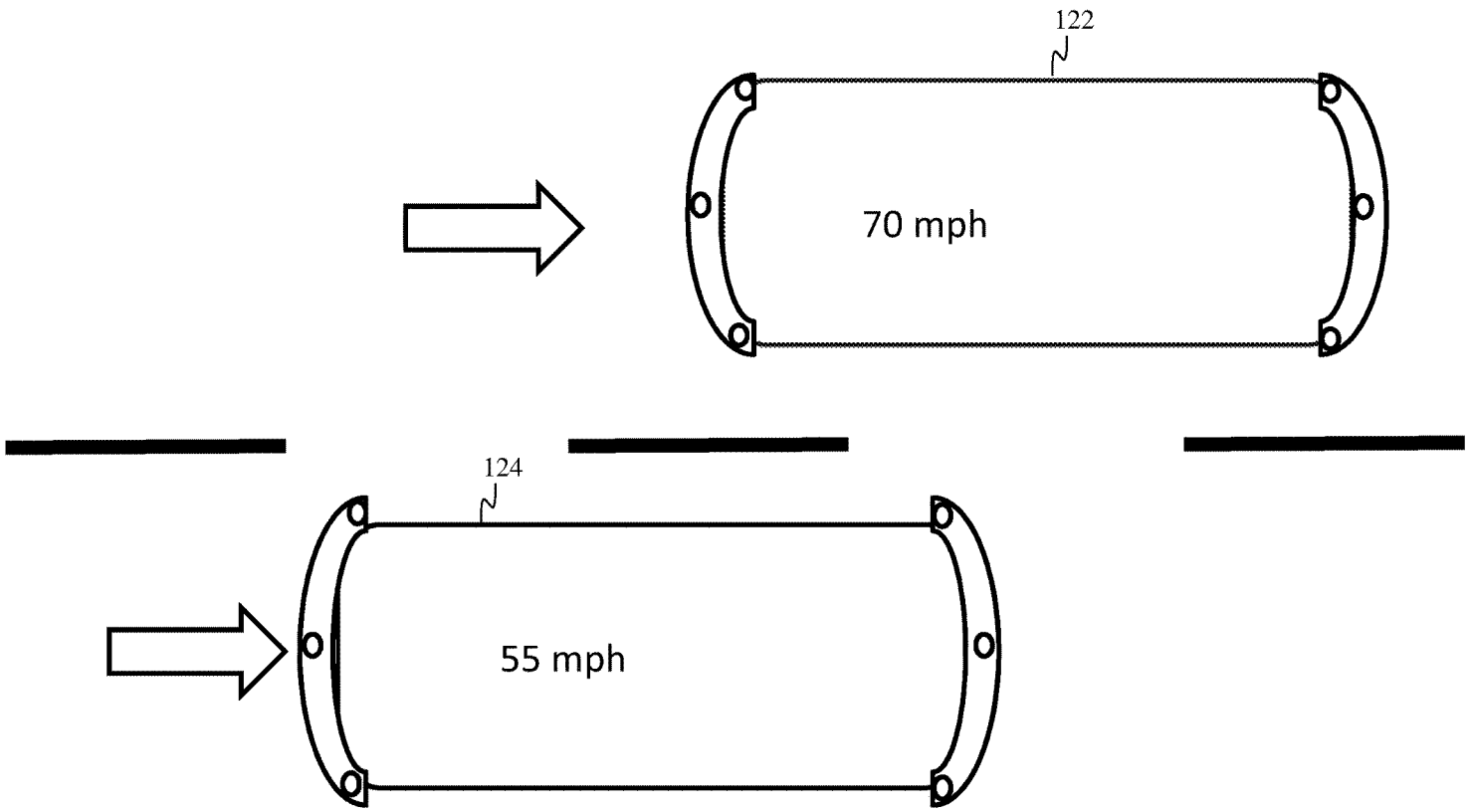

In step 312, as shown in FIG. 5E, vehicle 122 has moved over to the left lane and vehicle 124 has moved over to the right lane.

In step 314, each vehicle may transmit the passing data it generated and stored to the server 102 via network 106. Vehicle 122 may transmit passing data 202 to server 102 and vehicle 124 may transmit passing data 208 to server 102.

In one embodiment, the environment 100 may operate in conjunction with autonomous vehicles without having any conflict. Additionally, in one embodiment, the passing data 202, 208 may be stored by server 102 online and made accessible such that drivers may go online to see their driver history, i.e., how many times drivers have been passed. Drivers may also view all stored passing data, and view how many vehicles their system has reported. Viewers may see a trend regarding the same license plate showing up in multiple reports. Also, if a vehicle does not have the system 400, it could be alerted to a fast lane violation through the driver's cell phone, Bluetooth, WiFi, mail or its equivalent.

Figure 6:
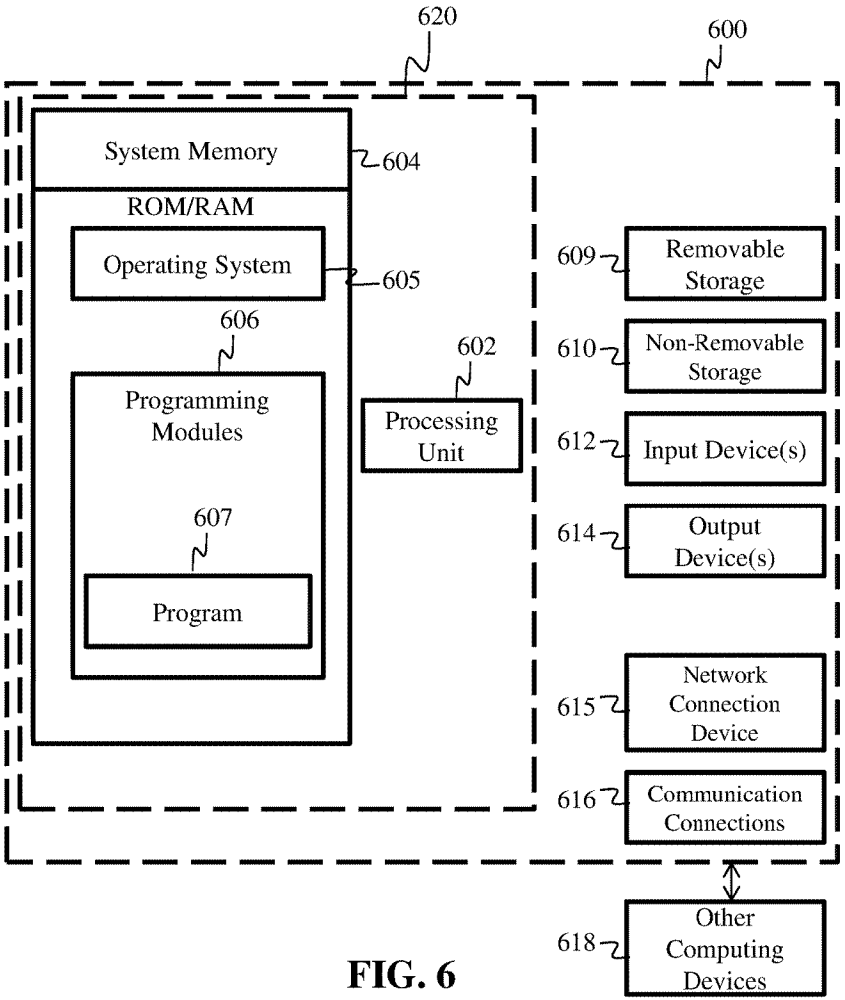
FIG. 6 is a block diagram of a system including a computing device, according to an example embodiment.

FIG. 6 is a block diagram of a system including an example computing device 600 and other computing devices. Consistent with the embodiments described herein, the aforementioned actions performed by server 102, device 120, processor 402, or computers in vehicles 122, 124 may be implemented in a computing device, such as the computing device 600 of FIG. 6. Any suitable combination of hardware, software, or firmware may be used to implement the computing device 600. The aforementioned system, device, and processors are examples and other systems, devices, and processors may comprise the aforementioned computing device. Furthermore, computing device 600 may comprise an operating environment for systems 100, 400 and processes 200, 300, as described above. Processes 200, 300 may operate in other environments and are not limited to computing device 600.

With reference to FIG. 6, a system consistent with an embodiment herein may include a plurality of computing devices, such as computing device 600. In a basic configuration, computing device 600 may include at least one processing unit 602 and a system memory 604. Depending on the configuration and type of computing device, system memory 604 may comprise, but is not limited to, volatile (e.g. random access memory (RAM)), nonvolatile (e.g. read-only memory (ROM)), flash memory, or any combination or memory. System memory 604 may include operating system 605, and one or more programming modules 606. Operating system 605, for example, may be suitable for controlling computing device 600's operation. In one embodiment, programming modules 606 may include, for example, a program module 607 for executing the actions of vehicles 122, 124, processor 402, server 102, device 120. Furthermore, embodiments herein may be practiced in conjunction with a graphics library, other operating systems, or any other application program and is not limited to any particular application or system. This basic configuration is illustrated in FIG. 6 by those components within a dashed line 620.

Computing device 600 may have additional features or functionality. For example, computing device 600 may also include additional data storage devices (removable and/or non-removable) such as, for example, magnetic disks, optical disks, or tape. Such additional storage is illustrated in FIG. 6 by a removable storage 609 and a non-removable storage 610. Computer storage media may include volatile and nonvolatile, removable and non-removable media implemented in any method or technology for storage of information, such as computer readable instructions, data structures, program modules, or other data. System memory 604, removable storage 609, and non-removable storage 610 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 600. Any such computer storage media may be part of device 600. Computing device 600 may also have input device(s) 612 such as a keyboard, a mouse, a pen, a sound input device, a camera, a touch input device, etc. Output device(s) 614 such as a display, speakers, a printer, etc. may also be included. Computing device 600 may also include a vibration device capable of initiating a vibration in the device on command, such as a mechanical vibrator or a vibrating alert motor. The aforementioned devices are only examples, and other devices may be added or substituted.

Computing device 600 may also contain a network connection device 615 that may allow device 600 to communicate with other computing devices 618, such as over a network in a distributed computing environment, for example, an intranet or the Internet. Device 615 may be a wired or wireless network interface controller, a network interface card, a network interface device, a network adapter or a LAN adapter. Device 615 allows for a communication connection 616 for communicating with other computing devices 618. Communication connection 616 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 604, including operating system 605. While executing on processing unit 602, programming modules 606 (e.g. program module 607) may perform processes including, for example, one or more of the stages of the processes 200, 300 as described above. The aforementioned processes are examples, and processing unit 602 may perform other processes. Other programming modules that may be used in accordance with embodiments herein may include electronic mail and contacts applications, word processing applications, spreadsheet applications, database applications, slide presentation applications, drawing or computer-aided application programs, etc.

Generally, consistent with embodiments herein, program modules may include routines, programs, components, data structures, and other types of structures that may perform particular tasks or that may implement particular abstract data types. Moreover, embodiments herein may be practiced with other computer system configurations, including hand-held devices, multiprocessor systems, microprocessor-based or programmable consumer electronics, minicomputers, mainframe computers, and the like. Embodiments herein may also be practiced in distributed computing environments where tasks are performed by remote processing devices that are linked through a communications network. In a distributed computing environment, program modules may be located in both local and remote memory storage devices.

Furthermore, embodiments herein may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments herein may also be practiced using other technologies capable of performing logical operations such as, for example, AND, OR, and NOT, including but not limited to mechanical, optical, fluidic, and quantum technologies. In addition, embodiments herein may be practiced within a general purpose computer or in any other circuits or systems.

Embodiments herein, for example, are described above with reference to block diagrams and/or operational illustrations of methods, systems, and computer program products according to embodiments herein. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments herein have been described, other embodiments may exist. Furthermore, although embodiments have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A system for logging and reporting on slow drivers in a fast lane, the system comprising:

a set of proximity sensors on a first vehicle, wherein said set of proximity sensors are configured for detecting a passage of another vehicle on a right side of the first vehicle;

at least one processor on the first vehicle, the at least one processor communicatively coupled with the set of sensors on the first vehicle, the at least one processor configured for logging a number of times that the another vehicle passed the first vehicle on a right side of the first vehicle;

at least one transmitter on the first vehicle, the transmitter communicatively coupled with the at least one processor on the first vehicle, the transmitter configured for wirelessly transmitting said number of times to a vehicle that is detected as passing the first vehicle on a right side of the first vehicle, a set of proximity sensors on a second vehicle, wherein said set of proximity sensors on the second vehicle are configured for detecting a passage of another vehicle on a left side of the second vehicle;

at least one receiver on the second vehicle, the at least one receiver communicatively coupled with the at least one processor on the second vehicle, the at least one receiver configured for wirelessly receiving communications from another vehicle;

at least one processor on the second vehicle, the at least one processor on the second vehicle communicatively coupled with the set of sensors on the second vehicle and the at least one receiver on the second vehicle, the at least one processor configured for storing said number of times received via said at least one receiver; and at least one transmitter on the second vehicle, the transmitter communicatively coupled with the at least one processor on the second vehicle, the transmitter configured for wirelessly transmitting said number of times to a third party via a communications network.

2. The system of claim 1, wherein the set of proximity sensors on the first vehicle comprises a set of six proximity sensors.

3. The system of claim 2, wherein the set of six proximity sensors on the first vehicle are positioned as follows: three of said set of six proximity sensors on the first vehicle are located near a front bumper of the first vehicle and three of said set of six proximity sensors on the first vehicle are located near a rear bumper of the first vehicle.

4. The system of claim 3, wherein said set of six proximity sensors on the first vehicle comprise laser based sensors.

5. The system of claim 3, wherein said set of six proximity sensors on the first vehicle comprise global navigation system based sensors.

6. The system of claim 1, wherein the set of proximity sensors on the first vehicle comprises a set of six proximity sensors.

7. The system of claim 6, wherein the set of six proximity sensors on the first vehicle are positioned as follows: two of said set of six proximity sensors on the first vehicle are located on a right side of the first vehicle, two of said set of six proximity sensors on the first vehicle are located on a left side of the first vehicle, one of said set of six proximity sensors on the first vehicle are located on a front side of the first vehicle, and one of said set of six proximity sensors on the first vehicle are located on a rear side of the first vehicle.

8. The system of claim 7, wherein two of said set of six proximity sensors on the first vehicle are located at or near corners of the first vehicle on the right side of the first vehicle.

9. The system of claim 8, wherein two of said set of six proximity sensors on the first vehicle are located at or near corners of the first vehicle on the left side of the first vehicle.

10. The system of claim 1, wherein the at least one processor of the first vehicle is further configured for:

detecting a speed of the first vehicle and disabling the set of proximity sensors on the first vehicle if said speed is below a predefined threshold; and detecting the speed of the first vehicle and enabling the set of proximity sensors on the first vehicle if said speed is above a predefined threshold.

11. The system of claim 10, wherein the at least one processor of the second vehicle is further configured for:

detecting a speed of the second vehicle and disabling the set of proximity sensors on the second vehicle if said speed is below a predefined threshold; and detecting the speed of the second vehicle and enabling the set of proximity sensors on the second vehicle if said speed is above a predefined threshold.

12. The system of claim 1, further comprising a camera located on the second vehicle, wherein the camera is configured to take and store an image of a license plate of the first vehicle, before the set of proximity sensors of the second vehicle detects the passage of the first vehicle on the left side of the second vehicle.

13. The system of claim 1, further comprising a set of pre-recorded voice messages or other signals stored on the second vehicle, wherein the transmitter of the second vehicle is configured to transmit certain ones of the pre-recorded messages or other signals to the first vehicle, when the set of proximity sensors of the second vehicle detects the passage of the first vehicle on the left side of the second vehicle.

14. The system of claim 13, wherein the receiver of the first vehicle is configured for receiving certain ones of the pre-recorded messages or other signals from the second vehicle, and further comprising an audio speaker communicatively coupled with the at least one processor on the first vehicle, the audio speaker configured for playing said certain ones of the pre-recorded messages or other signals received from the second vehicle.

15. The system of claim 13, further comprising a second set of pre-recorded voice messages or other signals stored on the first vehicle, wherein the transmitter of the first vehicle is configured to transmit certain ones of the pre-recorded messages or other signals to the second vehicle, when the set of proximity sensors of the first vehicle detects the passage of the second vehicle on the right side of the first vehicle.

16. The system of claim 15, wherein the receiver of the second vehicle is configured for receiving certain ones of the pre-recorded messages or other signals from the first vehicle, and further comprising an audio speaker communicatively coupled with the at least one processor on the second vehicle, the audio speaker configured for playing said certain ones of the pre-recorded messages or other signals received from the first vehicle.

17. A distributed system for logging and reporting on slow drivers in a fast lane, the distributed system comprising:

a computer system on a first vehicle, the computer system comprising:

a set of proximity sensors, wherein said set of proximity sensors are configured for detecting a passage of another vehicle on a right side of the first vehicle;

at least one processor, the at least one processor communicatively coupled with the set of sensors on the first vehicle, the at least one processor configured for logging a number of times that the another vehicle passed the first vehicle on a right side of the first vehicle;

at least one transmitter communicatively coupled with the at least one processor on the first vehicle, the transmitter configured for transmitting said number of times to a vehicle that is detected as passing the first vehicle on a right side of the first vehicle; and a computer system on a second vehicle, the computer system on the second vehicle comprising:

a set of proximity sensors configured for detecting a passage of another vehicle on a left side of the second vehicle;

at least one receiver communicatively coupled with the at least one processor on the second vehicle, the at least one receiver configured for receiving communications from another vehicle;

at least one processor communicatively coupled with the set of sensors on the second vehicle and the at least one receiver on the second vehicle, the at least one processor configured for storing said number of times received via said at least one receiver; and at least one transmitter communicatively coupled with the at least one processor on the second vehicle, the transmitter configured for transmitting said number of times to a third party via a communications network.

18. The system of claim 17, wherein the set of proximity sensors on the first vehicle and on the second vehicle each comprises a set of six proximity sensors.

19. The system of claim 18, wherein the set of six proximity sensors on the first vehicle and on the second vehicle are positioned as follows: two of said set of six proximity sensors on the first vehicle are located on a right side of the first vehicle, two of said set of six proximity sensors on the first vehicle are located on a left side of the first vehicle, one of said set of six proximity sensors on the first vehicle are located on a front side of the first vehicle, and one of said set of six proximity sensors on the first vehicle are located on a rear side of the first vehicle.

20. The system of claim 19, wherein said set of six proximity sensors on the first vehicle and on the second vehicle each comprise laser based sensors.

* * * * *